US005107084A

United States Patent [19]

Ueno et al.

[11] Patent Number: 5,107,084

[45] Date of Patent: Apr. 21, 1992

[54] ROCKING HANDLE FOR OPERATING A SWITCH

[75] Inventors: Satoru Ueno, Hirakata; Atsushi Hori, Obihiro, both of Japan

[73] Assignee: Matsushita Electric Works, Ltd., Japan

[21] Appl. No.: 631,143

[22] Filed: Dec. 20, 1990

[30] Foreign Application Priority Data

May 2, 1990 [JP] Japan ..... 2-116063
May 2, 1990 [JP] Japan ..... 2-116066

[51] Int. Cl.[5] ..... B65D 90/04; B65D 43/14

[52] U.S. Cl. ..... 200/457; 200/343; 200/523

[58] Field of Search ..... 200/343, 457, 523, 332, 200/330

[56] References Cited

U.S. PATENT DOCUMENTS 3,495,058 2/1970 Davy ..... 200/523
4,482,791 11/1984 Rendgen ..... 200/343
4,754,106 6/1988 Walker ..... 200/457

*Primary Examiner*—Renee S. Luebke
*Assistant Examiner*—David J. Walczak
*Attorney, Agent, or Firm*—Leydig, Voit & Mayer

[57] ABSTRACT

An operating switch has a push button provided in a housing of a switch body for operation when depressed by an operating lever pivoted on the housing. The operation of the push button causes a switch arrangement to be turned by a turning arrangement so that a movable contact is engaged with or disengaged from a stationary contact. The turning arrangement includes a sliding cam disposed along the interior face of the push button and having cam parts engageable with engaging projections of a pivotable actuator coupled resiliently to the switching arrangement upon performing a sliding movement in a direction perpendicular to the direction of movement of the push button.

9 Claims, 12 Drawing Sheets

ROCKING HANDLE FOR OPERATING A SWITCH

BACKGROUND OF THE INVENTION

This invention relates to operating switches and more particularly to a switch which can be made to perform a switching operation by depressing a lever in a manner similar to the manner in which a piano key is depressed.

The operating switches of the kind referred to are installed on a housing interior wall or the like for effective utilization in ON and OFF control of lighting fixtures or other loads.

DESCRIPTION OF RELATED ART

Known operating switches generally comprise a casing and a switching means provided in the casing. The switching means includes a movable contact provided on a movable contactor which is pivotally mounted with its lower portion acting as a fulcrum so as t perform switching operation with respect to a stationary contact provided on a stationary terminal plate. The switching means is operated through a lever disposed for seesaw motion, that is, a rocking motion, and the movable contactor is thereby actuated for switching on and off the stationary and movable contacts. In the above-described operating switch, however, there has a been a problem that a design restriction arises due to an inherent difference in stationary positions after every on or off operation of the lever. That is, the lever must rock from one position to another upon every operation of the switch, and an improvement in the operating ability has been demanded.

U.S. Pat. No. 3,576,962 discloses a push contact device in which an operating plate is placed on the top side of a base plate, a metal plate is attached to a pushrod connected to the operating plate, a first terminal is connected to an end of the metal plate, a stirrup movable member is carried on the other end of the metal plate, and a movable contact engageable with and disengageable from a second terminal is provided on the movable member, so contact operation does not rely on seesaw movement but on depression of the operating plate. With this arrangement, however, the movable contact is not arranged for alternate on and off operation with respect to opposing stationary contacts and the pushrod is coupled to the center of the operating plate, so it is necessary to depress the entire body of the operating plate, and operation is troublesome.

SUMMARY OF THE INVENTION

A primary object of the present invention is, therefore, to provide an operating switch that can perform an on-off operation when a lever is depressed in a manner similar to a piano key, that has few design restrictions, and that has improved operating ability.

According to the present invention, this object can be realized by an operating switch comprising a switch body in which a switching means having a movable contact is supported in a housing to be rockable for engagement and disengagement of the movable contact with and from a stationary contact also disposed in the housing. A pivoting means is provided for pivoting the switching means in response to depression of a push button to which a restoring spring force is applied. A pivoting actuator is coupled through a coil spring to the switching means and is pivotable in the direction of pivoting of the switching means. Engaging projections are formed on the actuator button opposing the push button, and a sliding cam is slidably disposed along an interior surface of the push button. The sliding cam is provided with engaging cam parts which are engageable with the engaging projections of the actuator upon depression of the push button and are slidable in a direction perpendicular to the direction of depression of the push button. A resilient restoring means integral with the sliding cam is engaged with the push button to provide a resilient force acting in a direction opposite the sliding direction of the sliding cam. An operating lever pivotably engaged with the housing is disposed so as to depress the push button when the operating lever is depressed.

Other objects and advantages of the present invention will become clear from the following detailed description of preferred embodiments when considered in conjunction with the accompanying drawings.

While the present invention will now be described with reference to the embodiments shown in the accompanying drawings, it should be appreciated that the intention is not to limit the invention only to these embodiments but rather to include all modifications, alterations and equivalent arrangements possible within the scope of the appended claims.

DESCRIPTION OF THE PREFERRED EMBODIMENTS

Figure 1:
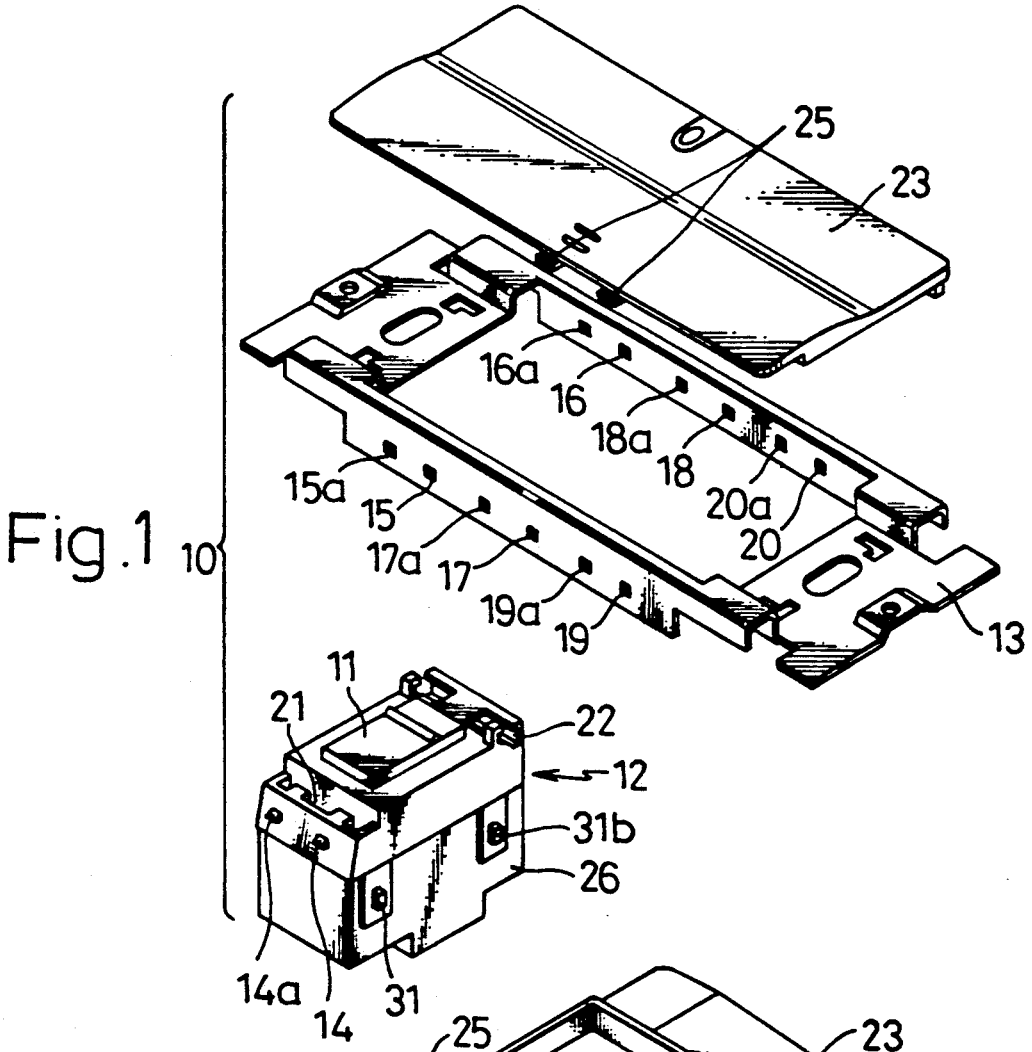
FIG. 1 is a perspective view of an operating switch according to the present invention, as disassembled into main components.
Figure 1A:
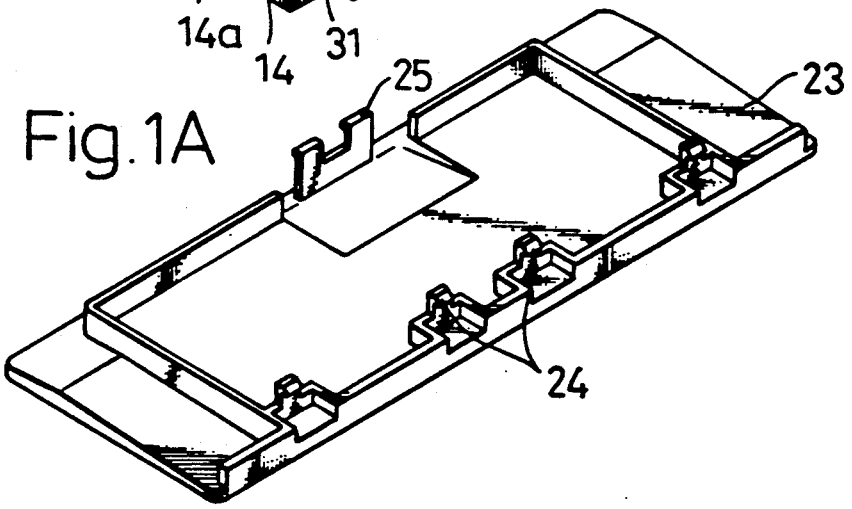
FIG. 1A is a reverse side perspective view of an operating lever of the switch shown in FIG. 1.

FIGS. 1 to 4 show an operating switch 10 according to the present invention in which a switch body 12 is switched on and off by a push button 11. This switch body 12 is of the modular type. Namely, a plurality (such as three) of switch bodies 12 of the same dimensions can be accommodated in the switch 10 as required. The switch body 12 is mounted on a mounting frame 13 by engaging two pairs of engaging projections 14, 14*a* and 14*b*, 14*c* formed in the upper portion of both longitudinal end faces of the body 12 (only the pair on one end face is shown in FIG. 1) into any opposing two pairs of engaging slots or holes 15, 15*a* and 16, 16*a* or 17, 17*a* and 17*b*, 17*c* or 19, 19*a* and 20, 20*a* provided in opposing side edges of the mounting frame 13. When, for example, only one switch body 12 is to be mounted on the mounting frame 13, the engaging projections 14–14*c* of the switch body 12 are engaged in the central pairs of engaging slots 17, 17*a* and 18, 18*a* of the mounting frame 13.

In the top side face at one of the longitudinal ends of the switch body 12, an engaging recess 21 is provided while on the other end side top face an engaging pivot part 22 is provided, and an operating lever 23 is mounted on the switch body 12 by projections 24 of the operating lever 23 which engage the recess 21 and by a pivoting projection 25 of the lever 23 which engages the engaging pivot part 22 of the body 12. When, in this case, the side of the lever 23 having the projections 2 is depressed and rotated with the other side having the pivoting projection 25 of the lever 23 acting as a fulcrum and with the projections 24 sliding in the recess 21, the push button 11 of the switch body 12 is depressed by the lever 2 through its optimally designed inner surface, and the switch body 12 is made to perform a switching operation. A restoring force against the depression of lever 23 is provided by button 11. More motion than required of the lever 23 can be prevented by means of hook-shaped ends of the engaging projections 24 of the lever 23, the ends engaging a locking edge of the engaging recess 22 so that the lever 23 can be restored always to the same non-actuated position.

Figure 2:
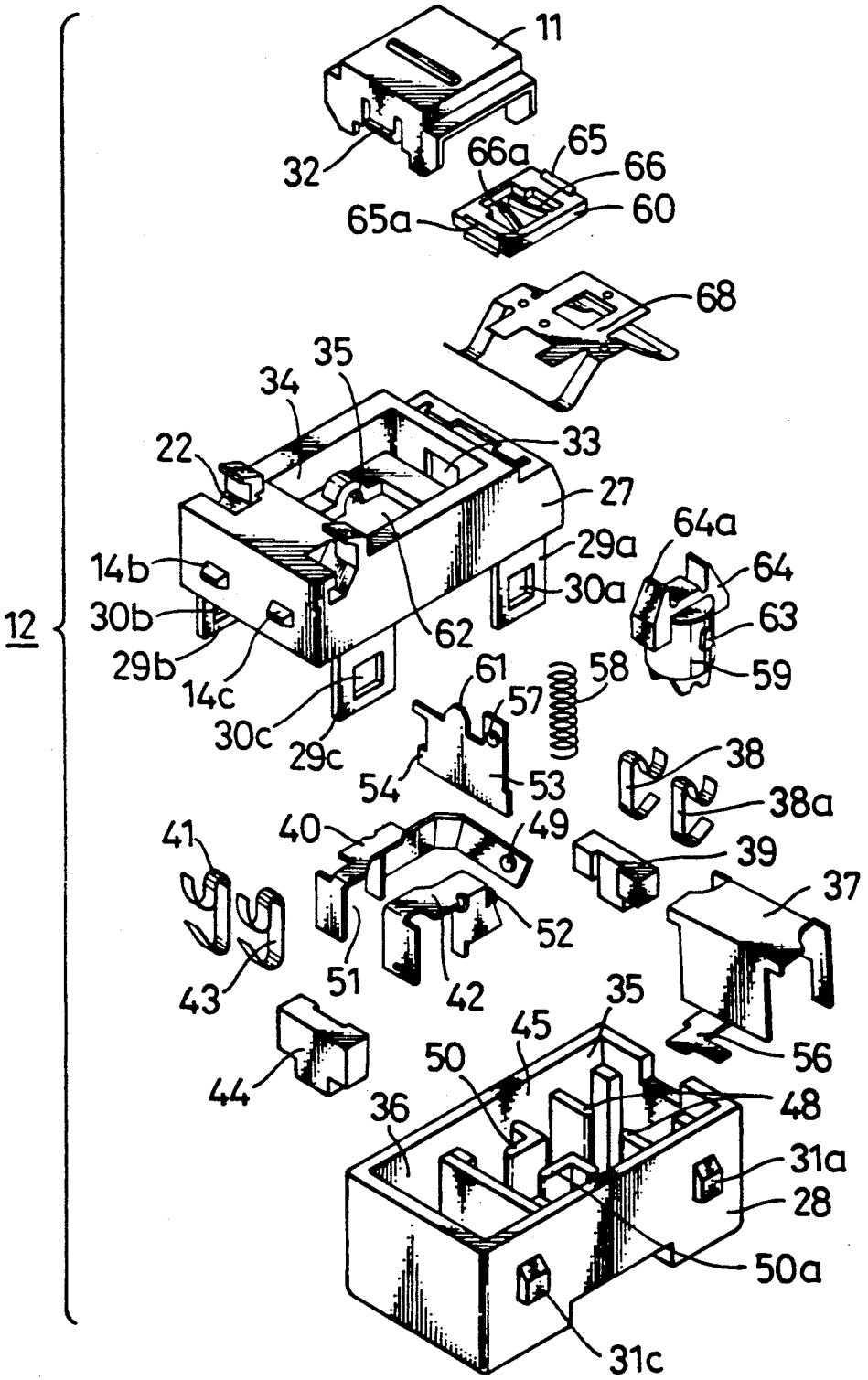
FIG. 2 is a perspective view of a switch body of the switch shown in FIG. 1, as disassembled into constituent parts.
Figure 3:
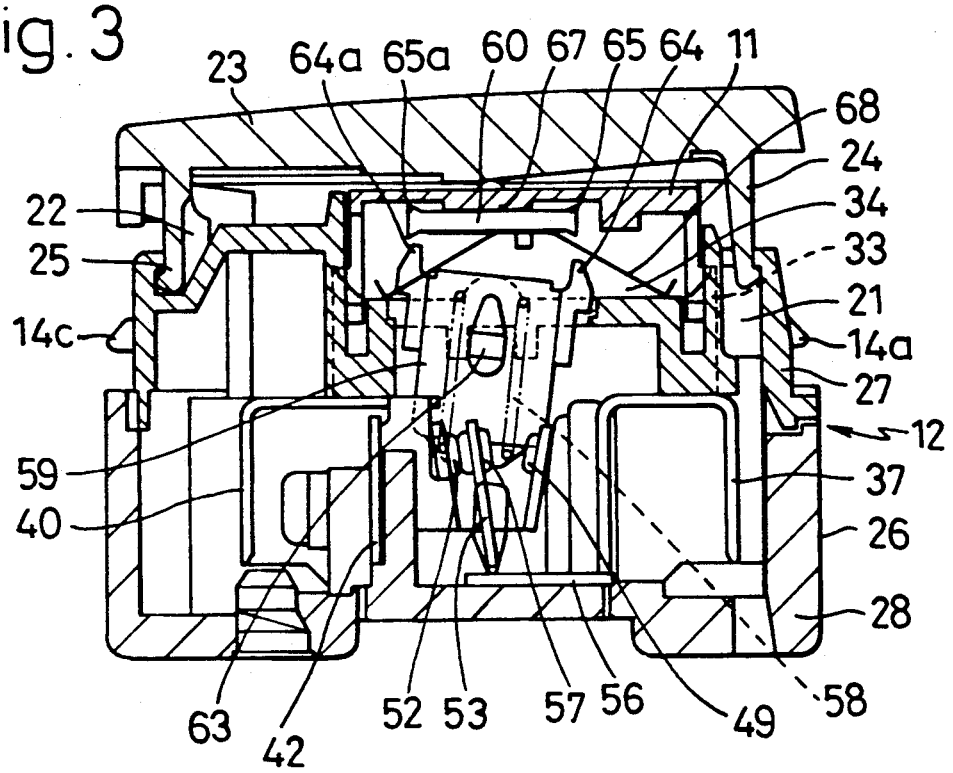
FIGS. 3 and 4 are explanatory cross-sectional views of the operation of the operating lever of the switch of FIG. 1.
Figure 4:
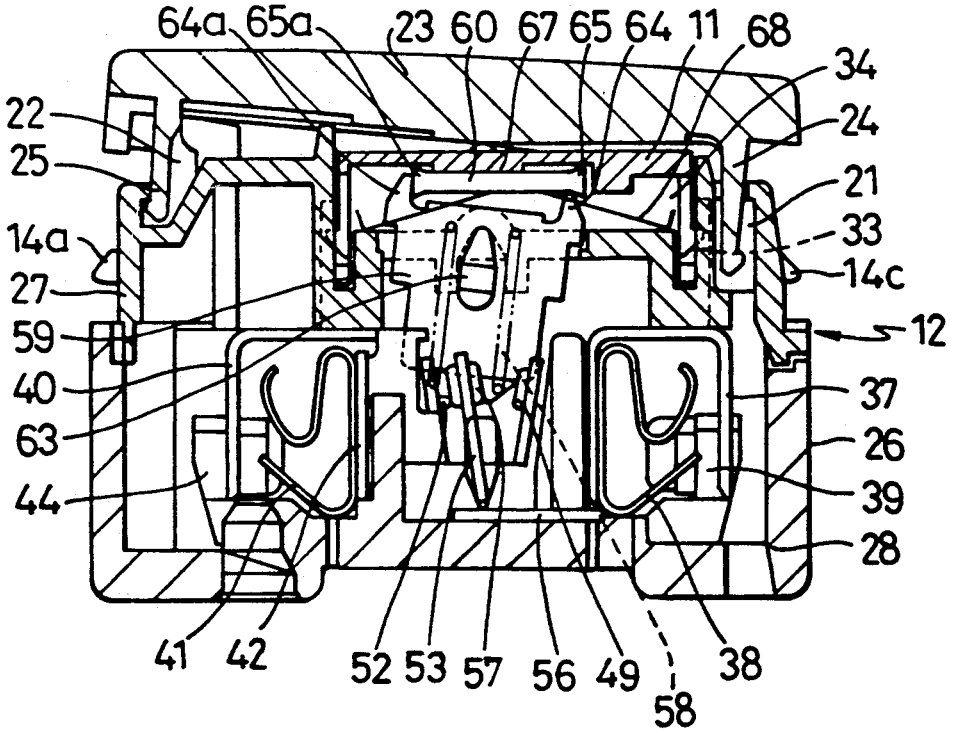

The switch body 12 comprises a hollow housing 26 formed of a synthetic resin and consisting of a top 27 and a base 28 which are assembled together by means of engaging strips 29, 29*a*, 29*b* and 29*c* extending from the top 27 and having engaging slots 30, 30*a*, 30*b* and 30*c*, respectively (only three of which are shown in FIG. 2). The strips 29–29*c* engage engaging projections 31, 31*a*, 31*b* and 31*c* projecting from both side walls of the base 28 (only two of these projections are shown in FIG. 2). The engaging projections 14–14*c* of the switch body 12 are provided on the top 27 for mounting the body 12 on the mounting frame 13, and the engaging recess 21 is also provided in the top 27 at the end having engaging projections 14 and 14*a*. The recess 21 provides the end with enough resiliency to make it possible to smoothly engage the projections 14 and 14*a* into the slots of the mounting frame 13. Further, the top 27 is provided with an open-topped chamber 34 for receiving the push button 11 in a manner such that it is movable vertically, i.e., toward and away from the bottom wall of the chamber 34. The chamber 34 has opposing side walls in which are formed engaging recesses 33 for receiving engaging projections 32 formed in the longitudinal ends of the push button 11. Bearing grooves 35 for receiving an actuator (to be described below) are formed in the bottom wall of the chamber 34.

The housing base 28 has connecting terminal receiving sections 35 and 36 formed at both of its longitudinal ends. Section 35 houses a common terminal plate 37, locking springs 38 and 38*a*, and a releasing button 39, while section 36 houses a first connecting terminal assembly of a terminal plate 40 and locking spring 41 as well as a second connecting terminal assembly of a terminal plate 42, a locking spring 43, and a release button 44 acting commonly to the first and second connecting terminal assemblies. Between the connecting terminal receiving sections 35 and 36 is defined a central receiving section 45.

In the present instance, the terminal plate 40 of the first connecting terminal assembly disposed in receiving section 36 has a portion that extends along an inner side wall of the central receiving section 45 and is then bent toward the center of the section 36 so as to lie along a support stud 48 on one end of the central receiving section 45. A stationary contact 49 is secured to the end of the extending portion of the terminal plate 40. Coupling strips 51 are provided on the base of the terminal plate 40 for embraceably engaging an end part of a support stud 50 disposed to oppose the support stud 48 in the central receiving section 45 on one lateral side thereof. The terminal plate 42 of the second terminal assembly is formed to ride astride another support stud 50*a* formed in the central receiving section 45 on the other lateral side thereof and to have an extended end bent to oppose the end of the terminal plate 40 having the stationary contact 49 thereon. Another stationary contact 52 is secured to the extended end of the plate 42 to oppose the contact 49.

The housing base 28 includes a wall having a recess (not shown) in which a switching means comprising a movable terminal plate 53 is freely engaged on a projection 54 of the plate 53, so that the movable terminal plate 53 is rockable within an angular range defined by an angle of the recess. This movable terminal plate 53 is formed of a conducting material and is brought into contact at its lower end with a conducting bearing plate part 56 which is integral with the common terminal plate 37 and disposed between support studs 48, 50 and 50*a* of the central receiving section 45. A movable contact 57 is secured to the upper end of the movable terminal plate 53 so that, as the movable terminal plate 53 rocks about the lower end as a fulcrum, the movable contact 57 will alternately contact the stationary contacts 49 and 52 of the terminal plates 40 and 42, thereby performing a switching operation.

The switching means comprising the movable terminal plate 53 is interlocked with a turning means which comprises a coil spring 58, a cylindrical pivoting actuator 59, and a sliding cam 60 disposed along the inner face of the push button 11. One end of the coil spring 58 is engaged with an upward projection 61 of the movable terminal plate 53 and the other end is inserted into an open bottomed axial hole of the actuator 59 so as to impart to the movable terminal plate 53 a turning action in response to a rocking motion of the actuator 59, as will be described later. The actuator 59 is disposed so as to project through an aperture 62 in the bottom wall of the chamber 34 of the housing top 27 into chamber 34, while a pair of triangular shaft projections 63 formed on opposing sides of the cylindrical body of the actuator 59 freely engage with the bearing grooves 35 of the housing top 27. A rectangular portion is formed at the top of the actuator 59, and a pair of engaging projections 64 and **64*a* project from both longitudinal ends of the rectangular portion in a direction perpendicular to the direction in which the shaft projections 63** project.

The sliding cam 60 has a substantially rectangular frame-shaped portion and is preferably made of a thermoplastic resin such as polyacetal which has high elasticity. A pair of camming projections 65 and **65*a* are provided on both ends of the frame-shaped portion of the cam 60 and are slidingly engageable with the engaging projections 64 and 64*a* at the top of the actuator 59. The sliding cam 60 further includes a pair of resilient strips 66 and 66*a* integral with the frame-shaped portion and extending into the frame-shaped portion in the widthwise direction thereof and gradually approaching each other at their ends. The push button 11 has a projection 67 at the center of its inner surface which is held between the resilient strips 66 and 66*a* so that when the sliding cam 60 slides in the lengthwise direction of the cam 60, a restoring force will be exerted on the cam 60 by resilient strip 66 or 66*a* acting against the projection 67. Further, a restoring spring 68 is disposed between the push button 11 and the bottom of the chamber 34 of the housing top 27. The spring 68 is preferably formed with a central top portion that is coupled to the push button 11 and with side legs that are gradually opened in the downward direction away from the push button 11 and that resiliently engage with the bottom of the chamber 34, whereby the push button 11 and eventually the lever 23 are constantly urged upward, away from the switch body 12**.

Figure 5:
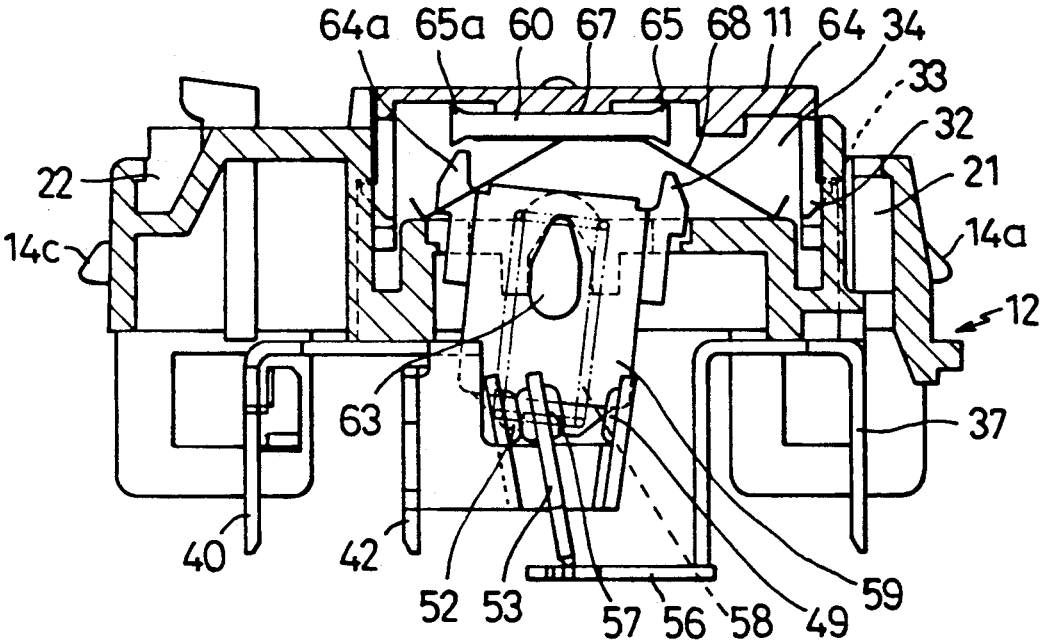
FIGS. 5, 7, 9 and 11 are cross-sectional views of a part of the switch body in the switch of FIG. 1, showing different operating states of the switch body.
Figure 6:
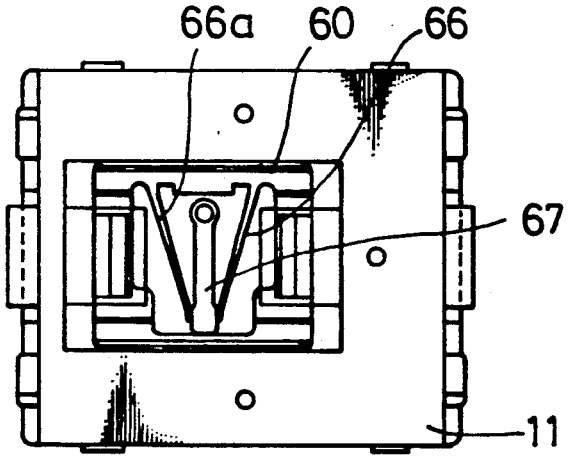
FIGS. 6, 8, 10 and 12 are bottom plan views of a push button with a sliding cam in different operating states thereof.
Figure 7:
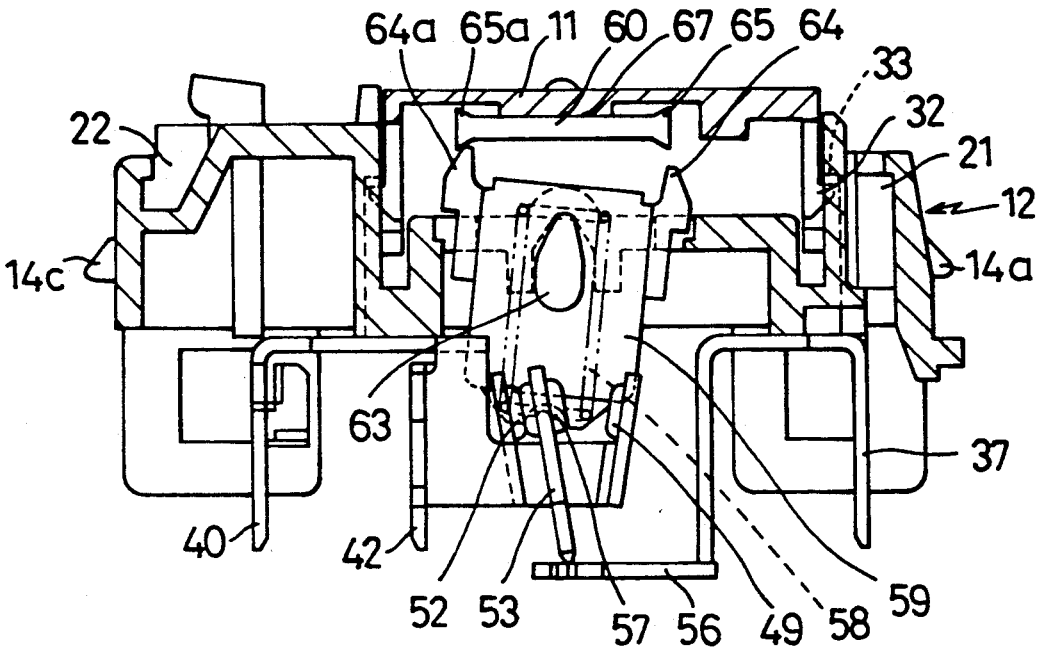
Figure 8:
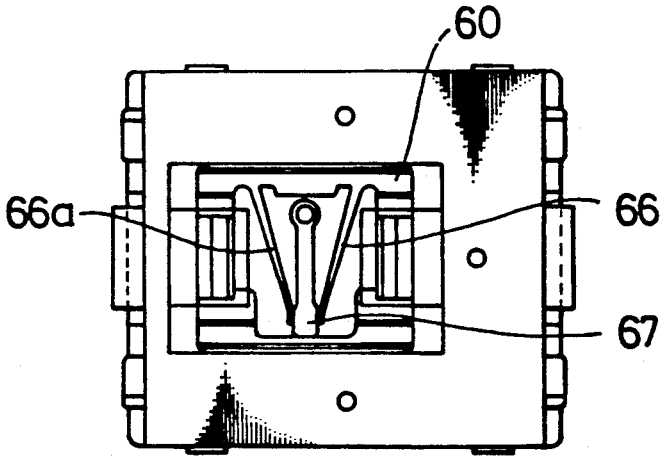

Depression of the push button 11 against the resilient force of the restoring spring 68 by depression of the lever 23 on its side having the engaging projections 24 from the state shown in FIGS. 5 and 6 causes the sliding cam 60 to be pushed down as well, upon which the camming projection **65*a* on one side of the sliding cam 60 engages at a part of its inside slope with the engaging projection 64*a* at one end of the actuator 59, which is in a tilted state as shown in FIGS. 7 and 8. As the push button 11 is further depressed in response to the depression of the lever 23, the engaging projection 64*a* of the actuator 59 is displaced to cause the actuator 59 to pivot so that when the coil spring 58 moves beyond its dead point, the actuator 59 will be pivoted to the position shown in FIGS. 9 and 10. As a result, the movable terminal plate 53 which is interlocked with the actuator 59 through the coil spring 58 is also caused to pivot, so that the movable contact 57 of the movable terminal plate 53 separates from the stationary contact 52 with which the movable contact 57 has been in contact and is brought into contact with the other stationary contact 49**, and a switching action is thereby carried out.

Figure 9:
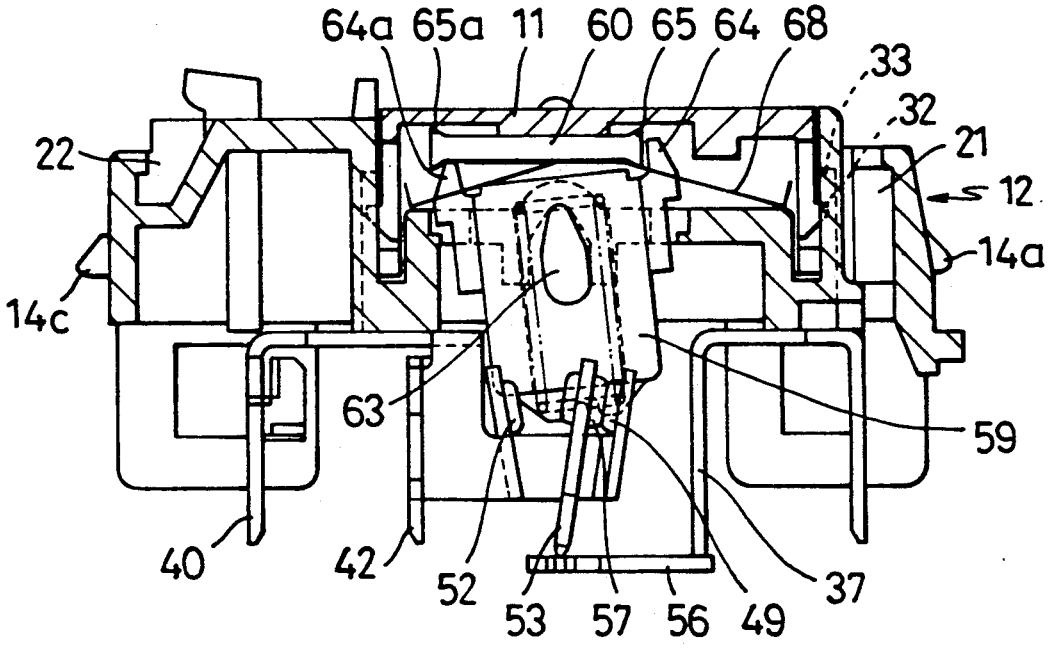
Figure 10:
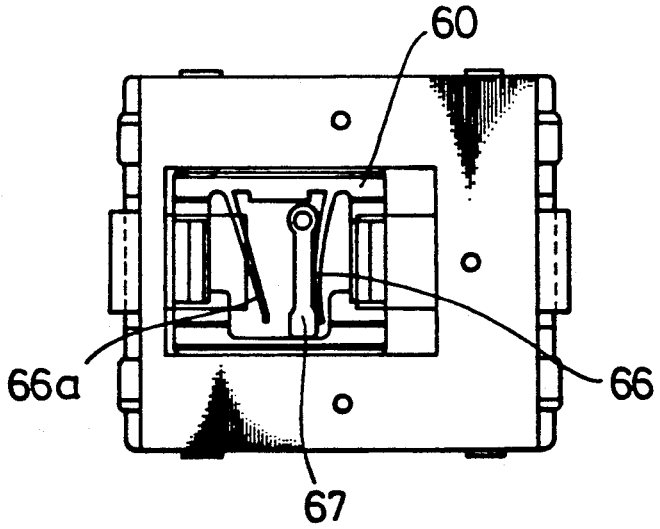

In the above-described arrangement, the distance between the engaging projections 64 and **64*a* of the actuator 59 as well as the distance between the engaging camming projections 65 and 65*a* are set such that when the sliding cam 60 slides with one of the camming projections 65 and 65*a* engaging with one of the engaging projections 64 and 64*a* of the actuator 59, the other of the camming projections 65 an 65*a* is positioned on the inner side of the other of the engaging projections 64 and 64*a*. As a result, switching can be smoothly and reliably performed, and the engaging projections 64 and 64*a* of the actuator 59 are displaced in the counterclockwise direction as shown in FIGS. 5, 7 and 9 following the rocking motion of the actuator 59 due to the depression of the push button 11, and the camming projections 65 and 65*a* interlocked with the engaging projections 64 and 64*a* are caused to slide against the resilient force of the resilient strip 66 or 66*a* in the leftward direction in the drawings, as shown in FIGS. 5, 7 and 9. In the present instance, even in an event of an upward movement of the other one of the engaging projections 64 and 64*a* upon a turning of actuator 59 beyond its level position, the slide cam means 60 still slides in the leftward direction so as not to hinder the actuator 59 from pivoting. Since the sliding cam 60 has no frictional resistance when sliding, the actuator 59 and the sliding cam 60** operate in a smooth manner.

Figure 11:
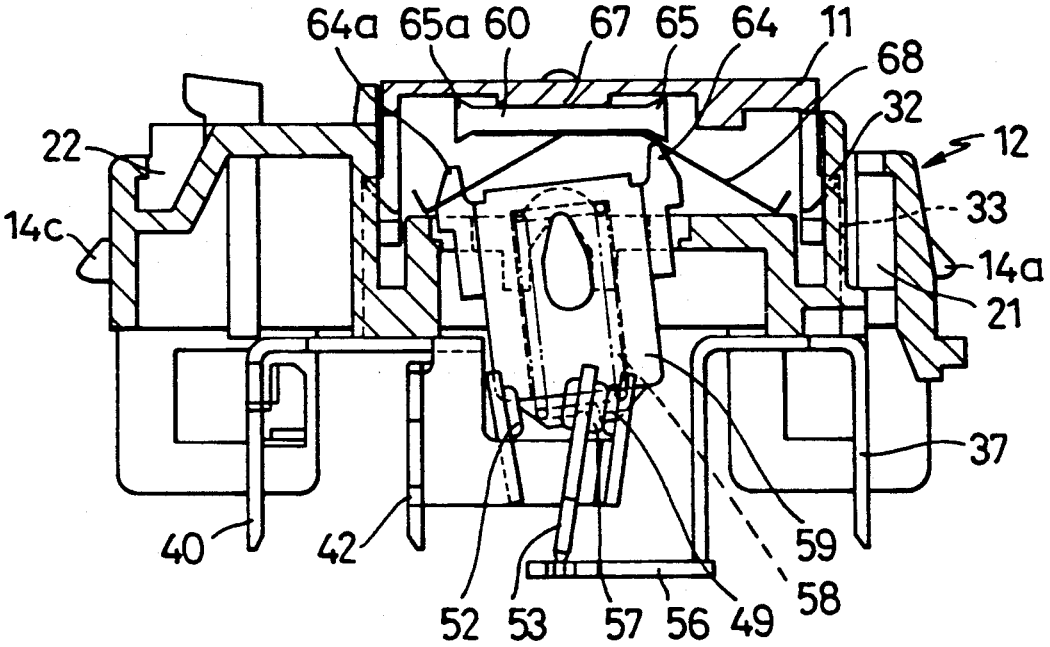
Figure 12:
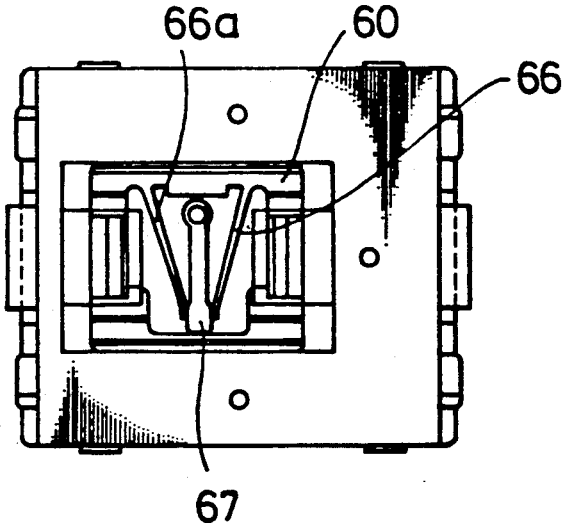

When the depressing force acting on lever 23 is released after the foregoing turning operation, the push button 11 and lever 23 are restored to their original positions by means of the resilient force of the restoring spring 68 as shown in FIGS. 11 and 12, and the sliding cam 60 is also caused to slide to be restored to its original position by the resilient force of the resilient strips 66 and **66*a***.

When lever 23 is depressed again on the side of the engaging projections 24, the above-described operation is carried out in reverse, so that the movable terminal plate 53 is rocked to carry out a contact switching operation, and the movable contact 57 is separated from the stationary contact 49 and brought into contact with the other stationary contact 52.

Figure 13:
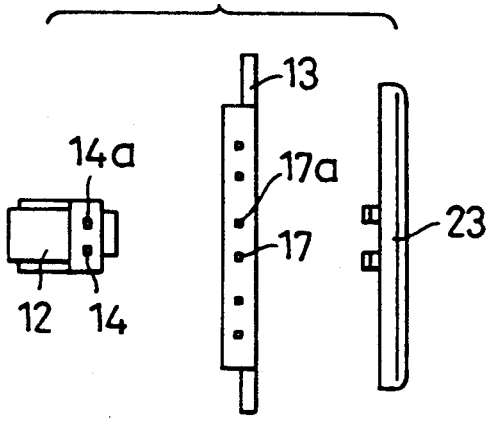
FIG. 13 is a schematic explanatory view showing the relationship of the switch body to the mounting frame and operating lever in the switch shown in FIG. 1.
Figure 14:
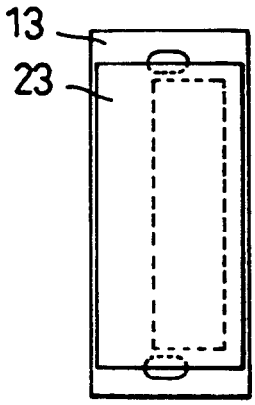
FIG. 14 is a schematic plan view of the switch shown in FIGS. 1 and 13.
Figure 15:
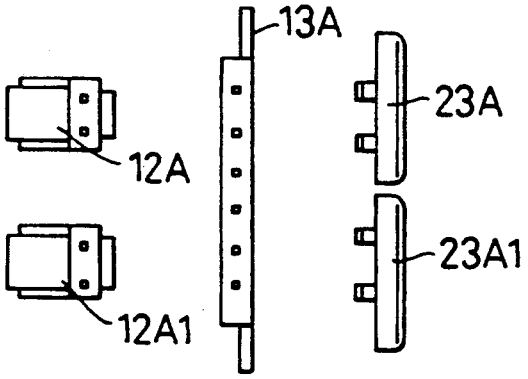
FIG. 15 is a schematic explanatory view showing the relationship of the switch body to the mounting frame and operating lever in another embodiment of the operating switch according to the present invention.
Figure 16:
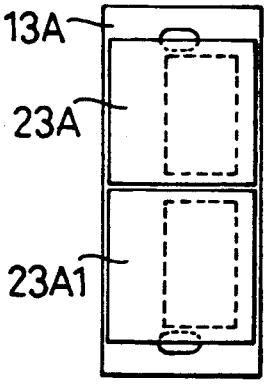
FIG. 16 is a schematic plan view of the switch shown in FIG. 15.
Figure 17:
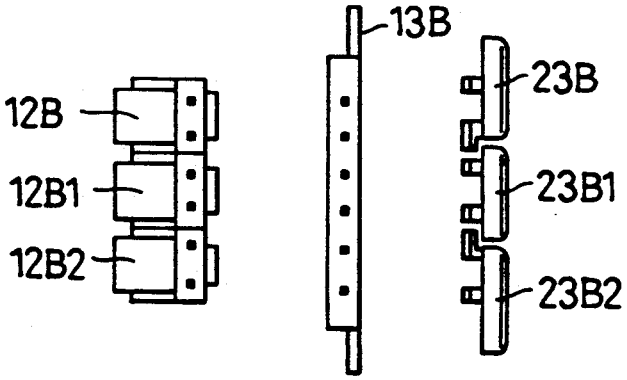
FIG. 17 is a schematic explanatory view showing the relationship of the switch body to the mounting frame and operating lever in another embodiment of the switch according to the present invention.
Figure 18:
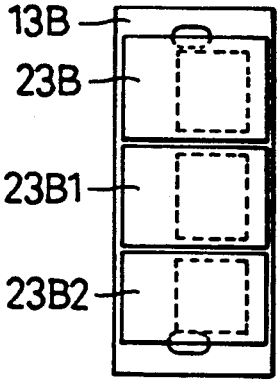
FIG. 18 is a schematic plan view of the switch shown in FIG. 17.

In the foregoing embodiment, as schematically shown in FIGS. 13 and 14, a single switch body 12 of the modular type is mounted at the center of the mounting frame 13 which is designed to concurrently support three modular type switch bodies, and a single operating lever 23 of a relatively large size is employed to activate the operating switch. However, the dimensions of the mounting frame 13, the number of switch bodies to be mounted thereon, and the number or size of lever 23 are selectable as required. As shown in FIGS. 15 and 16, for example, a mounting frame 13A is provided for concurrent mounting of two modular type switch bodies 12A and 12A1, while two operating levers 23A and 23A1 corresponding with the number of switch bodies 12A and 12A1 are used to operate the switch bodies. Further, it is also possible, as shown in FIGS. 17 and 18, to concurrently mount three modular type switch bodies 12B, 12B1 and 12B2 on the same mounting frame 13B, together with three levers 23B, 23B1 and 23B2 corresponding to the three switch bodies.

Figure 20:
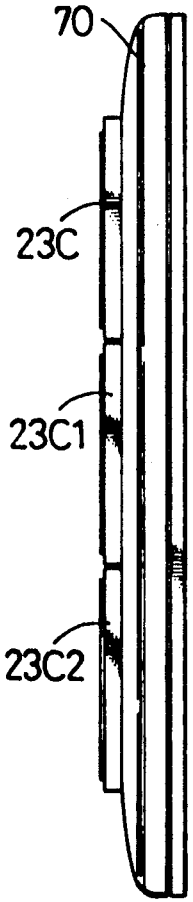
FIG. 20 is a side view of the switch shown in FIG. 17 or 19 with the switch bodies omitted.
Figure 19:
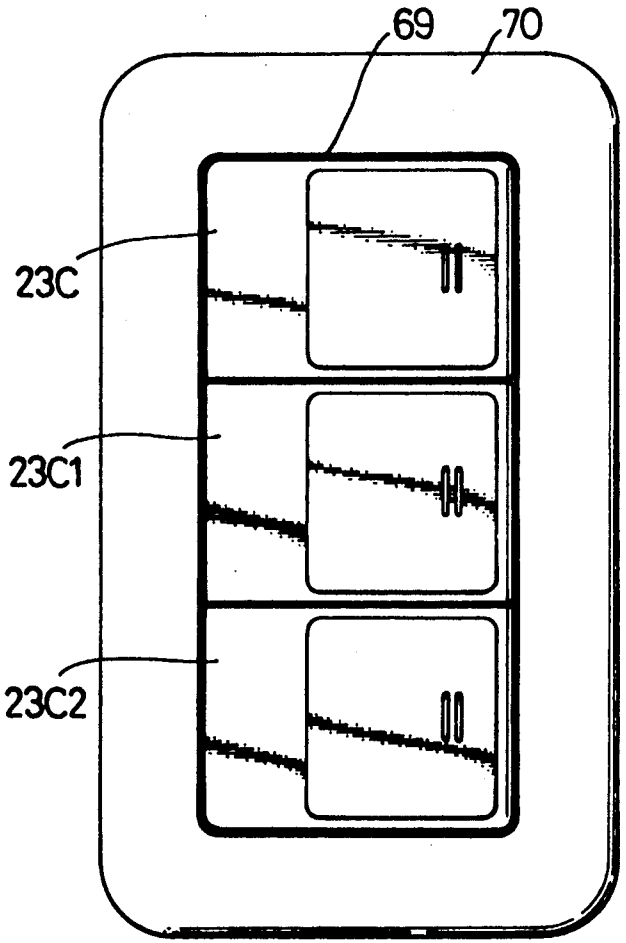
FIG. 19 is a more detailed plan view of the switch shown in FIG. 17.

While in the foregoing embodiment, the switch has been referred to as comprising only the switch body 12, the mounting frame 13 to which the switch body 12 is mounted, and lever 23 mounted on the switch body 12, when the mounting frame 13, which is generally formed of metal, is unacceptable in appearance, it is preferable to employ an ornamental plate 70 such as shown in FIGS. 19 and 20. The plate 70 is made of a synthetic resin and has an aperture 69 for disposing therein a plurality (three, for example) of operating levers 23C, 23C1 and 23C2, and it is mounted on the mounting frame 13 by means of screws or the like so as to cover the frame 13.

Figure 21:
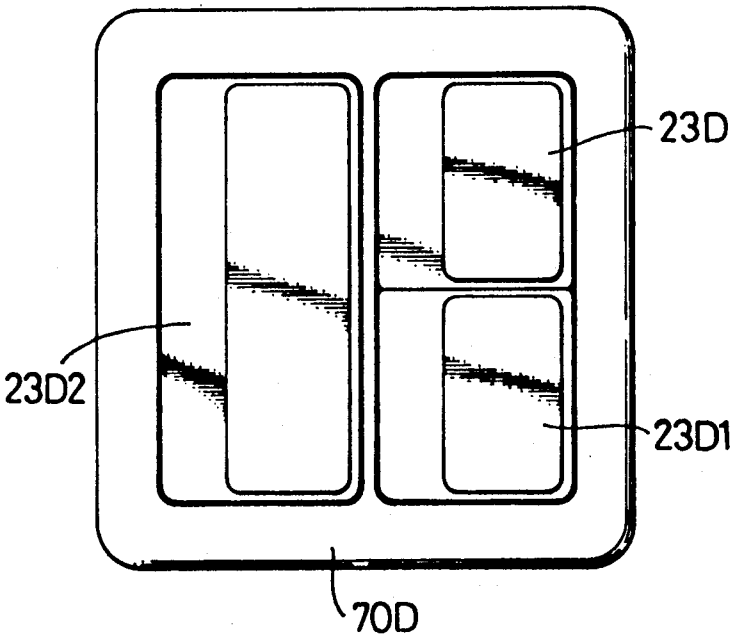
FIG. 21 is a detailed plan view of still another embodiment of the operating switch according to the present invention.

The dimensions and arrangement of the switch body 12, mounting frame 13 and lever 23 may be modified as shown in FIG. 21, in which two relatively small operating levers 23D and 23D1 are jointly mounted to a square mounting frame, together with a relatively large rectangular operating lever 23D2 disposed adjacent levers 23D and 23D1, and an ornamental plate 70D is fitted over the frame to surround the levers.

Figure 22:
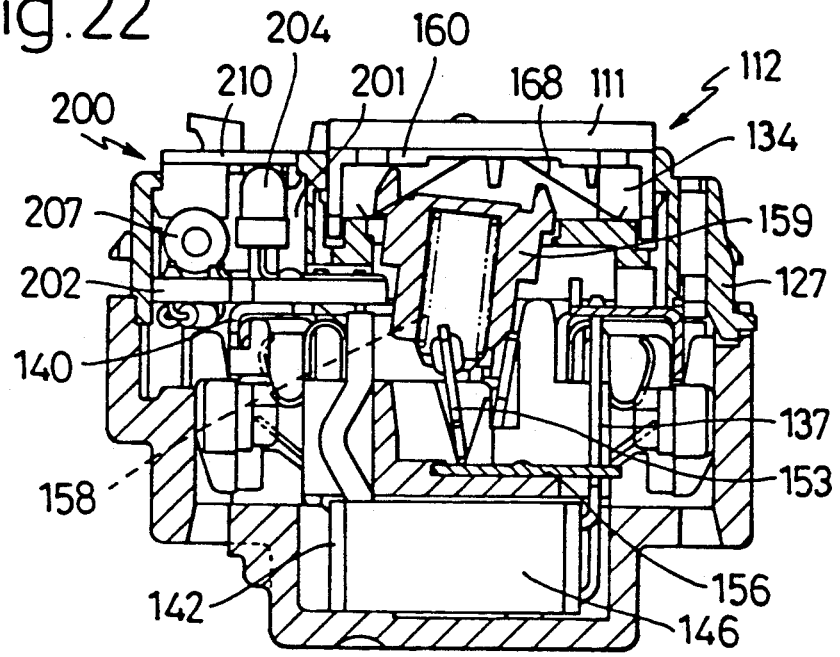
FIG. 22 is a cross-sectional view of another embodiment of the present invention.
Figure 24:
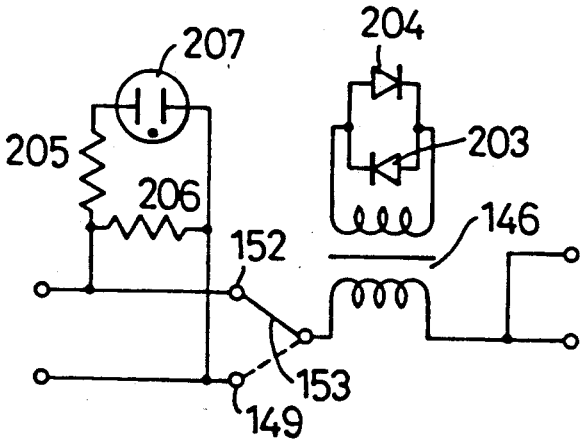
FIG. 24 is a diagram showing an indicator circuit employed in the switch shown in FIG. 22.
Figure 23:
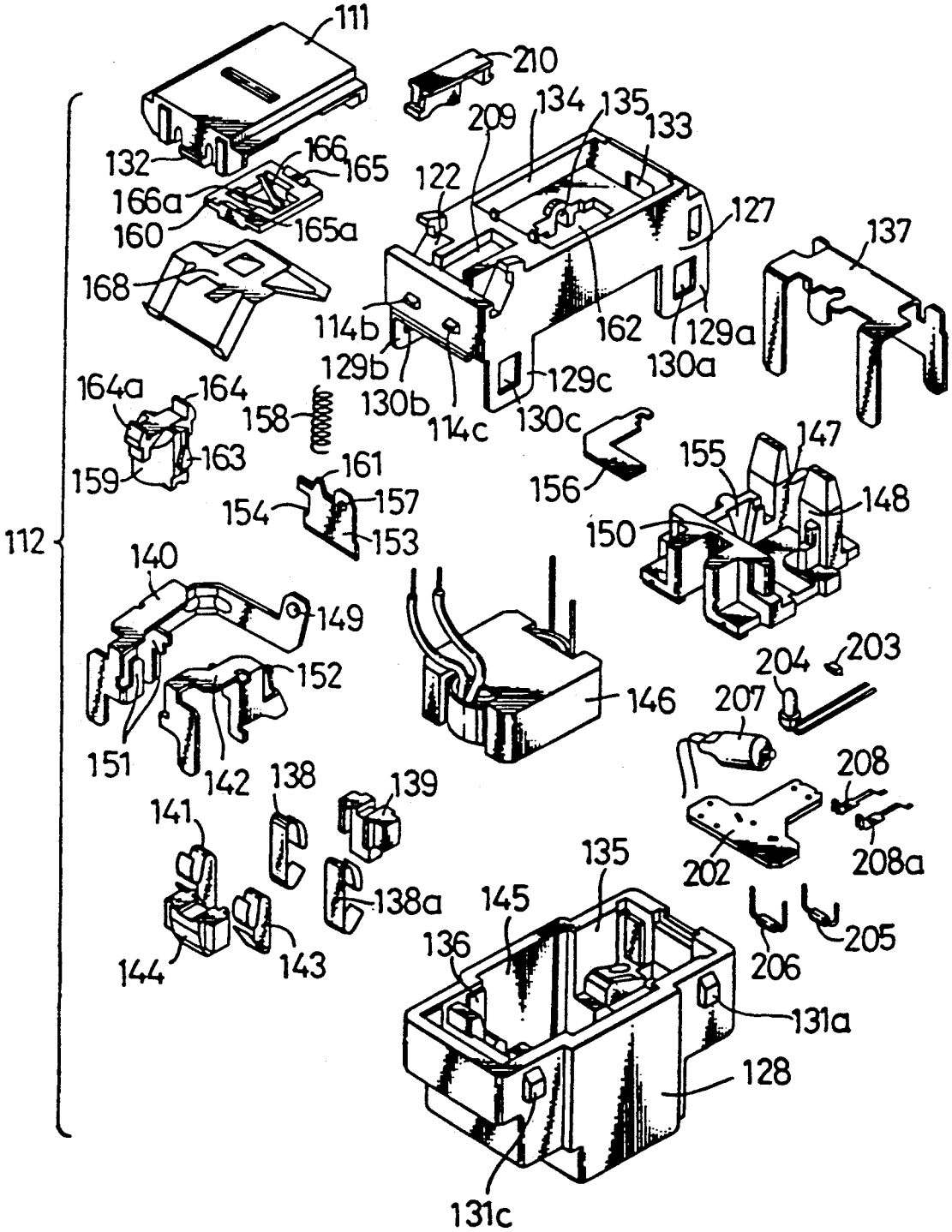
FIG. 23 is a perspective view of the switch shown in FIG. 22 as disassembled.

According to another feature of the present invention, the operating switch is able to indicate the operating state of the switch. FIGS. 22 and 23 show another embodiment of the present invention. As shown in the figures, the top 127 of a housing is provided with an indicator 200 adjacent a chamber 134. The indicator 200 generally comprises an indictor compartment 201 and a printed circuit board 202 on which an indicator circuit such as that shown in FIG. 24 is mounted. FIG. 24 shows a internal circuit of one of the switch bodies forming a three-way switch with two of the switch bodies. A luminous diode 204 with which a counter-electromotive-force preventing diode 203 is connected in parallel is inserted on the secondary side of a current transformer 146 connected between a common terminal plate 137 and a conducting support plate 156, and it is thereby indicated that the load of the switch body 112 is ON. On the other hand, a neon tube 207 to which resistors 205 and 206 are connected is inserted between terminal plates 140 and 142 to which the stationary contacts are secured, so that it can be indicated that the load connected to the switch body 112 is OFF by this neon tube 207. In the present instance, the connection of the circuit board 202 to the terminal plates 140 and 142 may be realized by means of resilient contactors 208 and 208*a* connected at one end to the printed circuit board 202 and resiliently contacted at the other end with the terminal plates 140 and 142.

The indicator compartment 201 has an aperture 209 formed in its top side, and the luminous diode 204 and neon tube 207 are disposed inside the aperture 209. Preferably, a light permeating cover 210 is fitted on the aperture 209, so that the operating state of the operating switch is readily and constantly visible through the cove 210. In the event that the load connected to the switch is lighting equipment, the foregoing arrangement will function as a pilot lamp that glimmers like a firefly and illuminates in the dark when the lighting equipment is turned off. In the embodiment of FIGS. 22 and 23, the base 128 of the housing has a central receiving section 145 which is expanded at its bottom for receiving therein a current transformer 146, and an inner frame 147 is disposed at a position above the current transformer 146 and corresponding to the position of the bottom plate of the housing base 28 in the foregoing embodiment. This inner frame 147 is provided with support studs 148 and 150 for seating the terminal plates 140 and 142, and with a lateral stud having a V-shaped recess 155 formed in a side face thereof for loosely receiving a projection 154 of a movable terminal plate 153 so as to allow the projection 154 to pivot in the recess 155. A conducting bearing plate part 156 is a separate member from the common terminal plate 137 but is connected thereto and pivotably supports the movable terminal plate 153. In the arrangement of FIGS. 22 and 23, other elements are the same as those in the embodiment of FIGS. 1–4 and are denoted by reference numerals higher by 100 than the reference numerals of the corresponding elements in FIGS. 1–4.

Figure 27:
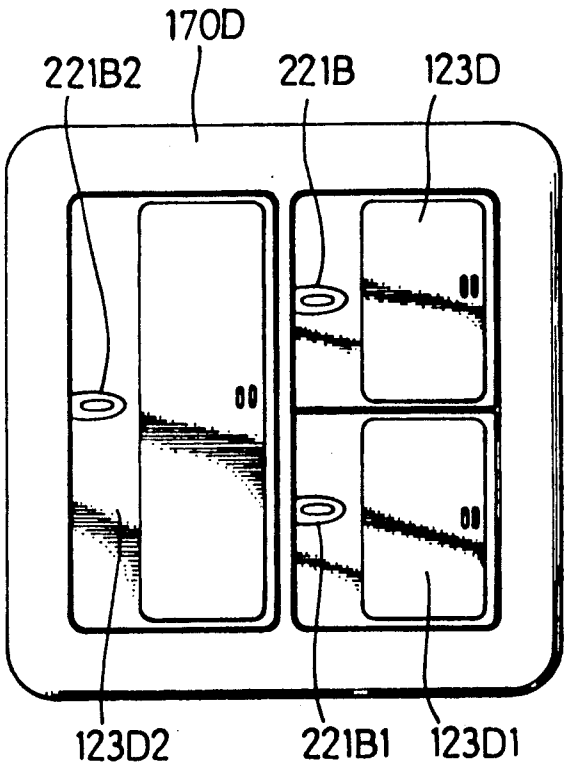
FIG. 27 is a detailed plan view of another embodiment of the operating switch according to the present invention.
Figure 26:
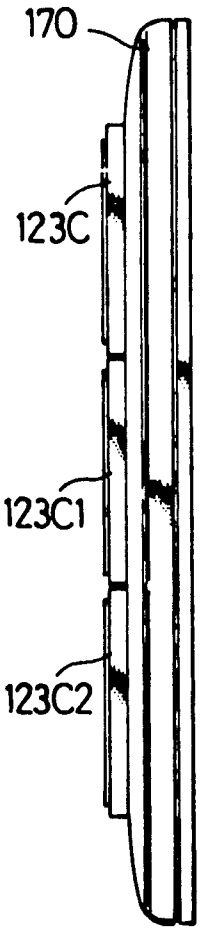
FIG. 26 is a side view of the switch shown in FIG. 25 with the switch bodies omitted.
Figure 25:
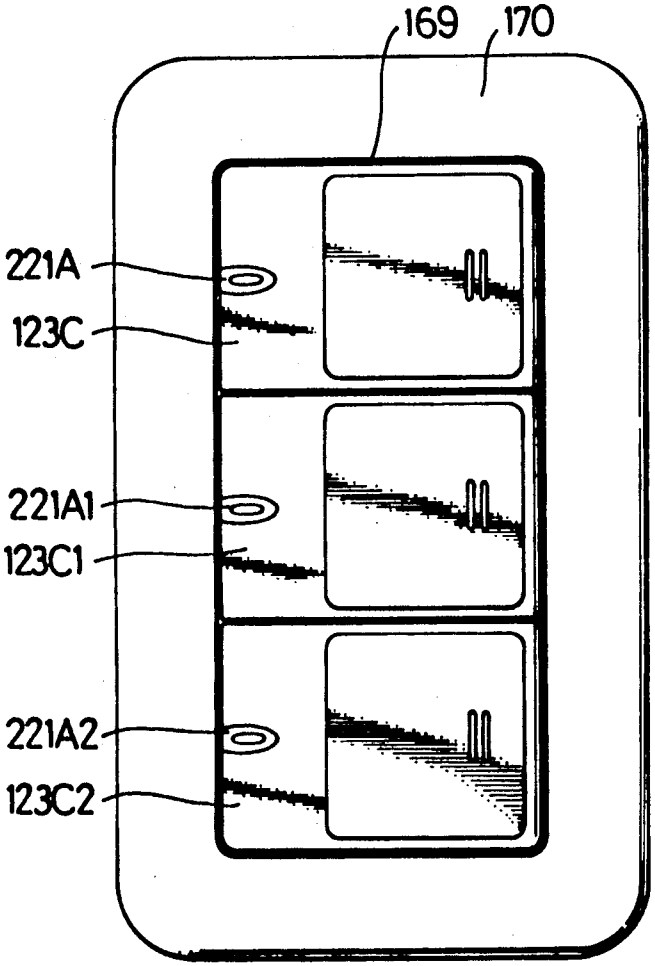
FIG. 25 is a detailed plan view of another embodiment of the operating switch of the present invention.

In the operating switch having an indicating capability as shown in FIGS. 22 and 23, the size of the mounting frame, the number of switch bodies to be mounted on the frame, and the size and number of levers 111 as well as the use of an ornamental plate having an aperture for housing the operating lever(s) may be properly selected as required. As shown in FIGS. 25 and 26, for example, three levers 123C, 123C1 and 123C2 may be disposed within the aperture 169 of an ornamental plate 170, in the same manner as in FIGS. 19 and 20, except for an additional provision of light permeating portions 221A, 221A1 and 221A2 corresponding in position to the light permeating covers of the indicators of the respective switch bodies. Alternatively, as shown in FIG. 27, two relatively small levers 123D and 123D1 arranged side by side and one relatively large lever 123D2 arranged adjacent the two other levers can all be disposed in an ornamental plate 170D. The levers 123D, 123D1 and 123D2 are provided with the light permeating portions 221B 221B1 and 221B2, respectively, at positions corresponding to the light permeating covers of the indicators in the switch bodies.

What is claimed is:

1. An operating switch comprising:

a switch body comprising a housing, a first stationary contact disposed in the housing, a contact support pivotably supported in the housing for movement between first and second positions, a movable contact mounted on the contact support so as to contact the first stationary contact when the contact support is in its first position, a push button movably supported by the housing for movement between a depressed position and a non-depressed position, a biasing member coupled to the push button so as to bias the push button towards its non-depressed position, an operating lever pivotably mounted on the housing and coupled to the push button to move the push button to its depressed position when the operating lever is pivoted, and pivoting means for pivoting the contact support between its first and second positions when the push button is moved to its depressed position, the pivoting means comprising an actuator pivotably mounted in the housing and having first and second engaging portions, a coil spring coupled between the actuator and the contact support to cause pivoting movement of the actuator to move the contact support between its first and second positions, a sliding cam slidably mounted on the push button for movement from a neutral position in a direction transverse to the direction from a movement of the push button between its depressed and non-depressed positions and having first and second engaging portions for engagement with the engaging portions of the actuator when the push button is in its depressed position, and restoring means for biasing the sliding cam towards the neutral position.

2. A switch as claimed in claim 1 wherein said housing has a pivot portion and a recess, and the operating lever has a first end with a projection formed thereon which is pivotably mounted on the pivot portion and a second end having a projection extending into the recess.

3. A switch as claimed in claim 1 further comprising a mounting frame, wherein a plurality of the switching bodies are mounted on the mounting frame.

4. A switch as claimed in claim 1 further comprising a first stationary terminal plate on which the first stationary contact is mounted, a second stationary terminal plate, and a second stationary contact mounted on the second stationary terminal plate opposing the first stationary contact, wherein the contact support comprises a movable terminal plate on which the movable contact is mounted and which is pivotably mounted in the housing for movement between a position in which the movable contact contacts the first stationary contact and a position in which the movable contact contacts the second stationary contact.

5. A switch as claimed in claim 1 wherein the sliding cam comprises a substantially rectangular frame having a first side opposing the push button and a second side opposing the actuator, and the engaging portions of the cam are formed on the second side.

6. A switch as claimed in claim 5 wherein the restoring means comprises a pair of resilient strips secured to the frame of the sliding cam and disposed on opposite sides of a portion of the push button.

7. A switch as claimed in claim 1 wherein one of the engaging portions of the sliding cam is disposed between the engaging portions of the actuator and one of the engaging portions of the actuator is disposed between the engaging portions of the sliding cam when the push button is in its depressed position.

8. A switch as claimed in claim 1 wherein the switch body further comprises a light permeating portion formed in the operating lever, a light emitting element disposed in the housing and visible when illuminated through the light permeating portion, and means for controlling the light emitting element in accordance with the position of the movable contact.

9. A switch as claimed in claim 8 further comprising a mounting frame on which a plurality of the switching bodies are mounted.

* * * * *

UNITED STATES PATENT AND TRADEMARK OFFICE

CERTIFICATE OF CORRECTION

PATENT NO. : 5,107,084

DATED : April 21, 1992

INVENTOR(S) : Ueno et al.

It is certified that error appears in the above-identified patent and that said Letters Patent is hereby corrected as shown below:

Claim 1, column 8, lines 57-58, change "from a" to --of--.

Signed and Sealed this

Third Day of August, 1993

*Attest:*

Michael K. Kirk

MICHAEL K. KIRK

*Attesting Officer*

*Acting Commissioner of Patents and Trademarks*